US007626323B2

(12) United States Patent
Hwang

(10) Patent No.: US 7,626,323 B2
(45) Date of Patent: Dec. 1, 2009

(54) ELECTRON EMISSION ELEMENT, ELECTRON EMISSION DISPLAY, AND METHOD OF MANUFACTURING ELECTRON EMISSION UNIT FOR THE ELECTRON EMISSION DISPLAY

(75) Inventor: Seong-Yeon Hwang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 351 days.

(21) Appl. No.: 11/500,376

(22) Filed: Aug. 8, 2006

(65) Prior Publication Data

US 2007/0046175 A1 Mar. 1, 2007

(30) Foreign Application Priority Data

Aug. 26, 2005 (KR) ..... 10-2005-0078749

(51) Int. Cl.
*H01J 1/62* (2006.01)

(52) U.S. Cl. ..... 313/495; 313/309

(58) Field of Classification Search ..... 313/495, 313/309, 310, 336, 351
See application file for complete search history.

(56) References Cited

U.S. PATENT DOCUMENTS

| | | | | |
|---|---|---|---|---|
| 5,319,279 | A * | 6/1994 | Watanabe et al. | 313/309 |
| 6,635,983 | B1 | 10/2003 | Raina et al. | |
| 2002/0136896 | A1 | 9/2002 | Takikawa et al. | |
| 2003/0042834 | A1 | 3/2003 | Dean et al. | |
| 2004/0130258 | A1 | 7/2004 | Oh | |
| 2005/0082964 | A1 * | 4/2005 | Konishi | 313/497 |
| 2005/0133779 | A1 | 6/2005 | Choi et al. | |
| 2005/0236965 | A1 * | 10/2005 | Yamamoto et al. | 313/496 |

FOREIGN PATENT DOCUMENTS

| | | |
|---|---|---|
| EP | 1 115 135 | 7/2001 |
| EP | 1 132 940 | 9/2001 |
| FR | 2 829 873 | 3/2003 |
| JP | 05-094760 | 4/1993 |
| JP | 06-124649 | 5/1994 |
| JP | 07-153369 | 6/1995 |
| JP | 11-162326 | 6/1999 |
| JP | 2000-100315 | 4/2000 |
| JP | 2005-183388 | 7/2005 |

OTHER PUBLICATIONS

*Extended European Search. Report* from the European Patent Office issued in Applicant's corresponding European Patent Application No. 06119344.7 dated Feb. 6, 2007.

* cited by examiner

*Primary Examiner*—Vip Patel
(74) *Attorney, Agent, or Firm*—Robert E. Bushnell, Esq.

(57) ABSTRACT

An electron emission element is provided with at least one electrode, an electron emission region, and a resistance layer for electrically connecting the electrode to the electron emission region. The resistance layer is formed of one of a metal oxide material and a metal nitride material.

16 Claims, 11 Drawing Sheets

ELECTRON EMISSION ELEMENT, ELECTRON EMISSION DISPLAY, AND METHOD OF MANUFACTURING ELECTRON EMISSION UNIT FOR THE ELECTRON EMISSION DISPLAY

CLAIM OF PRIORITY

This application makes reference to, incorporates the same herein, and claims all benefits accruing under 35 U.S.C.§119 from an application earlier filed in the Korean Intellectual Property Office on 26 Aug. 2005 and there duly assigned Serial No. 10-2005-0078749.

BACKGROUND OF THE INVENTION

1. Field of the Invention

The present invention relates to an electron emission display, and more particularly, to an electron emission element with a resistance layer and an electron emission display having such an electron emission element.

2. Description of the Related Art

Generally, electron emission elements are classified into those using hot cathodes as an electron emission source, and those using cold cathodes as the electron emission source. There are several types of cold cathode electron emission elements, including Field Emission Array (FEA) elements, Surface-Conduction Emission (SCE) elements, Metal-Insulator-Metal (MIM) elements, and Metal-Insulator-Semiconductor (MIS) elements.

The FEA element includes electron emission regions and cathode and gate electrodes that are driving electrodes. The electron emission regions are formed of a material having a relatively low work function or a relatively large aspect ratio, such as a carbonaceous material or a nanometer-size material, so that electrons can be effectively emitted when an electric field is applied to the electron emission region in a vacuum atmosphere.

A typical electron emission display using the FEA elements includes a first substrate on which electron emission regions and cathode and gate electrodes are disposed, and a second substrate on which phosphor layers and anode electrodes are disposed. The electron emission regions are electrically connected to the cathode electrodes, and the gate electrodes are disposed above the cathode electrodes with an insulating layer disposed therebetween.

With the above-described structure, when predetermined driving voltages are applied to the cathode and gate electrodes, electric fields are formed at the electron emission regions in pixel regions, which are defined by the overlapping regions between cathode and gate electrodes. If at a pixel region, the voltage difference between the cathode and gate electrodes is higher than a threshold value, electrons will be emitted from the electron emission regions. The emitted electrons are attracted by the anode electrodes, to which a high voltage is applied, colliding with the phosphor layers of the corresponding pixel regions, thereby exciting the phosphor layers.

When an unstable driving voltage is applied however, to the cathode or gate electrode, or there is a voltage drop due to an internal resistance of the cathode or gate electrode, or the electron emission regions and the driving electrodes are not precisely fabricated, there may be a intensity difference between the electric fields applied to the electron emission regions of the respective pixel regions.

Particularly, when the cathode electrodes are formed of a transparent conductive material, such as Indium Tin Oxide (ITO), in order to apply a rear surface light-exposing process during formation of the electron emission regions, the cathode electrodes have a resistance higher than that of the cathode electrodes formed of metal conductive materials.

The above-described intensity difference of electric fields between the pixel regions causes a difference in the amount of electron emissions between the pixel regions. This deteriorates the luminescence uniformity of the pixels and thus the quality of the display.

SUMMARY OF THE INVENTION

It is therefore an object of the present invention to provide an improved electron emission element, display device employing the improved electron emission element and process for manufacturing the improved emission element and the display device.

It is another object to provide an electron emission element that improves an electron emission uniformity of pixels, an electron emission display having the electron emission element, and a method of manufacturing an electron emission unit that includes the electron emission element.

In an exemplary embodiment of the present invention, an electron emission element may be constructed with at least one electrode, an electron emission region, and a resistance layer for electrically connecting the electrode to the electron emission region, and the resistance layer may be formed from either a metal oxide material or a metal nitride material.

The metal oxide material or the metal nitride material may include a metal selected from the group of Cr, Mo, Nb, Ni, W, Ta, Al, Pt and a combination thereof.

The electrode may include a first electrode and a second electrode spaced apart from the first electrode. The electron emission region is formed on the first electrode.

The first electrode may be formed of a transparent conductive material and the second electrode is formed of metal. In addition, the metal oxide material or the metal nitride material may include a metal that is identical to the metal of which the second electrode is formed.

In another exemplary embodiment, the electron emission display may be constructed with first and second substrates facing each other, a cathode electrode formed on the first substrate, an electron emission region electrically connected to the cathode electrode, a resistance layer electrically connected to the cathode electrode and the electron emission region, a diffusion barrier formed on the first substrate and covering the cathode electrode, the diffusion barrier having an opening located in correspondence with the electron emission region, a gate electrode formed above the diffusion barrier with an insulating layer interposed between the diffusion barrier and the gate electrode, the gate electrode having an opening located in correspondence to the electron emission region, a phosphor layer formed on the second substrate, and an anode electrode formed on the phosphor layer.

The resistance layer may be formed from either a metal oxide material or a metal nitride material.

The diffusion barrier may include an insulation material selected from a group of $SiO_2$, TiO, $Si_3N_4$, TiN, and a combination thereof.

The cathode electrode may include a first electrode and a second electrode spaced apart from the first electrode, and the electron emission region may be formed on the first electrode.

The second electrode may have an opening within which the first electrode is disposed and the resistance layer may be formed at both sides of the first electrode.

The electron emission display may further include additional first electrodes that are arranged within the opening of the second electrode and additional resistance layers electrically connected to the first electrodes.

The electron emission display may further include a focusing electrode formed above the gate electrode with an insulating layer interposed between the gate electrode and the focusing electrode.

In still another exemplary embodiment, a method of manufacturing an electron emission unit, which incorporates the electron emission element, contemplates forming a first electrode on a substrate, the first electrode being formed from a transparent conductive material, forming a second electrode on the substrate, the second electrode contacting the first electrode and being formed from a metal, forming a diffusion barrier on the substrate, forming first and second openings in the diffusion barrier, the first opening exposing a portion of the first electrode and the second opening exposing a portion of the second electrode, and forming a resistance layer by either oxidizing or nitriding the exposed portion of the second electrode.

The method may further include forming an insulating layer over the substrate, in the course of which the resistance layer is formed.

The formation of the insulating layer may include applying an oxide material on the substrate and drying and firing the oxide material, in the course of which the exposed portion of the second electrode by the second opening is oxidized to form the resistance layer formed of a metal oxide material.

Alternatively, the formation of the insulating layer may include applying a nitride material on the substrate and drying and firing the nitride material, in the course of which the exposed portion of the second electrode by the second opening is nitrided to form the resistance layer of a metal oxide material.

The transparent conductive material may be ITO or IZO (Indium Zinc Oxide), and the metal is selected from a group of Cr, Mo, Nb, W, Ta, Al, Pt and a combination thereof.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF INVENTION

The present invention will now be described more fully with reference to the accompanying drawings, in which exemplary embodiments of the invention are shown.

Figure 1:
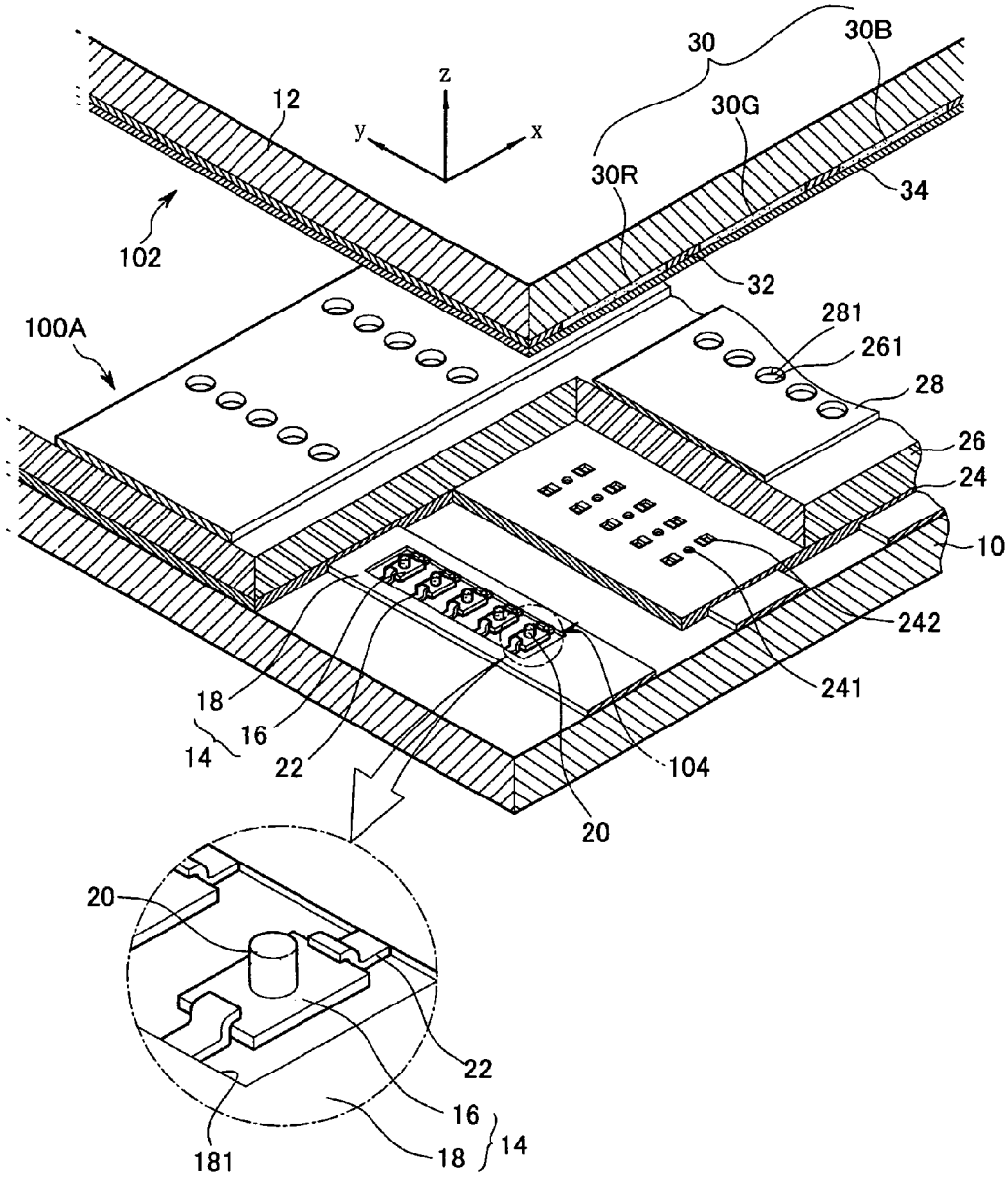
FIG. 1 is a partial exploded perspective view of an electron emission display constructed as an embodiment of the present invention.
Figure 2:
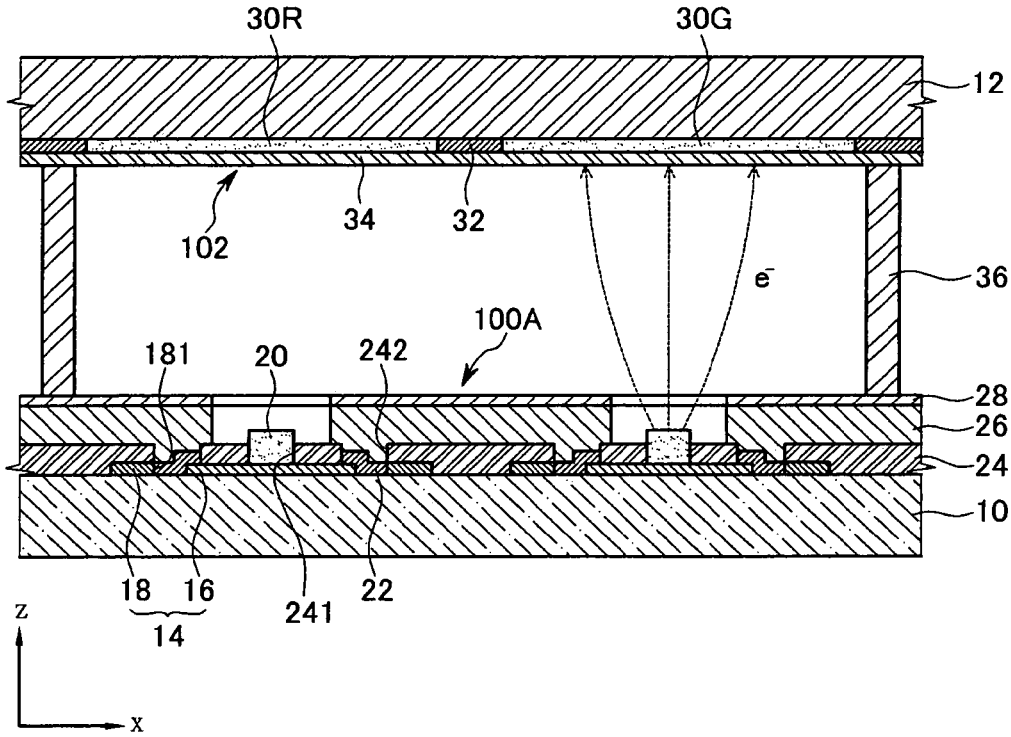
FIG. 2 is a partial cross-sectional view of the electron emission display of FIG. 1.
Figure 3:
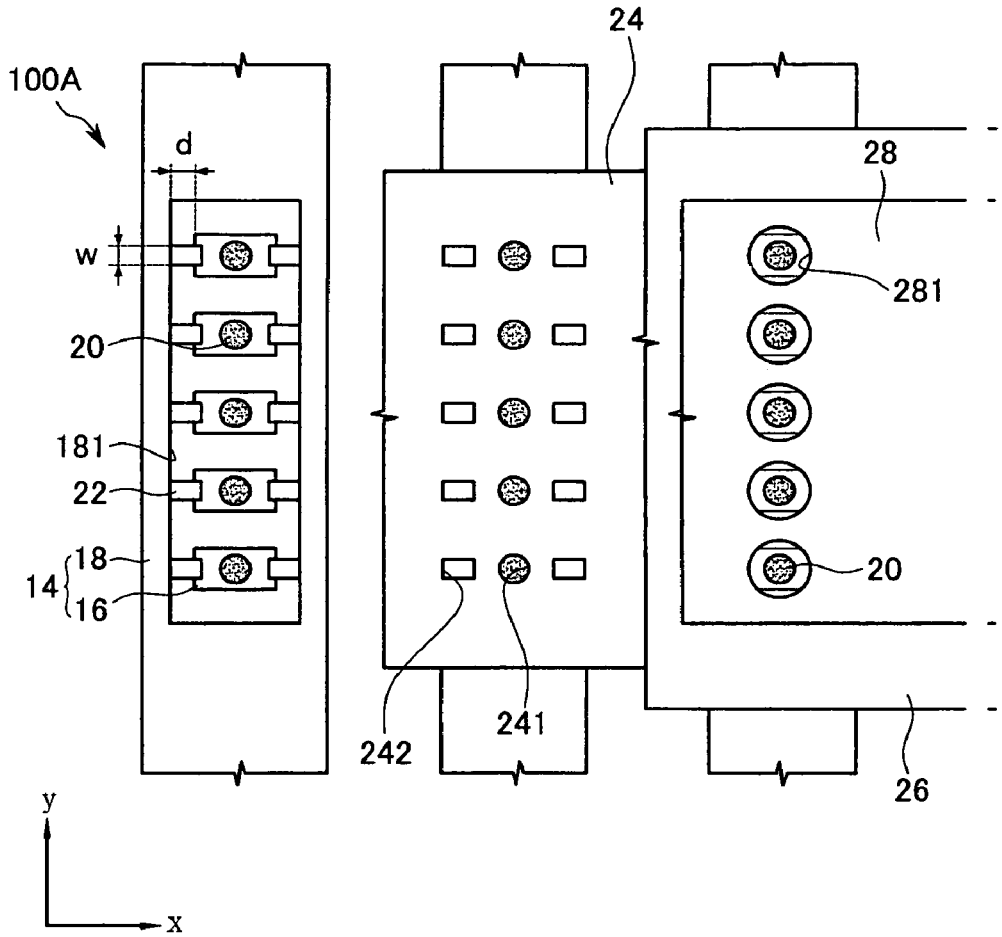
FIG. 3 is a partial top view of an electron emission unit of the electron emission display of FIG. 1.

FIGS. 1 through 3 shows an electron emission display constructed as one embodiment according to the principles of the present invention;

Referring now to FIGS. 1 through 3, an electron emission display constructed as an embodiment of the present invention includes first and second substrates 10 and 12. A sealing Xs member (not shown) is provided at the peripheries of first and second substrates 10 and 12 to seal them together, thus forming a sealed vacuum vessel. The interior vacuum level of the vacuum vessel is kept to approximately $10^{-6}$ Torr.

An electron emission unit 100A is formed on a surface of first substrate 10 facing second substrate 12 and a light emission unit 102 is formed on a surface of second substrate 12 facing first substrate 10. Light emission unit 102 emits visible light generated by the electrons emitted from electron emission unit 100A.

In electron emission unit 100A, cathode electrodes 14 formed spaced uniformly apart in a striped pattern are arranged on first substrate 10 in a direction of a y-axis (see FIG. 1).

In this embodiment, cathode electrode 14 includes first electrodes 16 and a second electrode 18 spaced apart from first electrodes 16. Second electrode 18 is provided with an opening 181 within which first electrodes 16 are disposed.

First electrodes 16 may be formed from a transparent conductive material such as ITO (Indium Tin Oxide) and IZO (Indium Zinc Oxide). Second electrode 18 may be formed of a metal such as Cr, Mo, Nb, Ni, W, Ta, Al, Pt, and a combination thereof, each having a resistance lower than that of first electrodes 16.

Electron emission regions 20 are formed on each first electrode 16 and first electrodes 16 are electrically connected to second electrode 18 via resistance layers 22. Therefore, when a driving voltage is applied to second electrode 18, electron emission regions 20 receive current, which is required for emitting electrons, via resistance layers 22 and first electrodes 16. Resistance layer 22 may have a specific resistance of approximately $10^3$~$10^5$ Ωcm.

Electron emission regions 20 may be formed from a carbonaceous material or a nanometer-size material that can emit electrons when an electric field is applied thereto in a vacuum atmosphere. For example, electron emission regions 20 can be formed from carbon nanotubes, graphite, graphite nanofibers, diamonds, diamond-like carbon, fullerens ($C_{60}$), silicon nanowires, or a combination thereof. Electron emission regions 20 can be formed by a screen-printing process, a chemical vapor deposition process, a direct growth process, or a sputtering process.

In this embodiment, resistance layer 22 may be formed from a metal oxide material or a metal nitride material that may include a metal selected from a group of Cr, Mo, Nb, Ni, W, Ta, Al, Pt, and a combination thereof. Especially, resistance layer 22 may include a metal identical to a metal contained in second electrode 18.

The metal oxide material and the metal nitride material for resistance layer 22 is a cermet that has relatively high heat resistance. Therefore, resistance layer 22 of this embodiment has a stable quality and a constant specific resistance even after being subjected to a high temperature process.

First and second electrodes 16 and 18 are placed on first substrate 10 and resistance layers extend from both sides of each first electrode 16 to the second electrode 18. The resistance value of each resistance layer 22 may be controlled by varying a distance "d" between first electrode 16 and second electrode 18 or a width "w" of resistance layer 22 (see FIG. 3).

Resistance layer 22 may contact not only a side surface of the corresponding first electrode 16 but also a side surface of second electrode 18. Alternatively, as shown in FIG. 2, resistance layer 22 may overlap onto a portion of a top surface of the corresponding first electrode 16. In the second case, since the contact area between resistance layer 22 and the corresponding first electrode 16 increases, the contact resistance between resistance layer 22 and the corresponding first electrode 16 can be further reduced as compared to the first case.

In the drawings, although first electrodes 16 are formed in a rectangular shape and arranged along a longitudinal axis of second electrode 18 within opening 181 of second electrode 18, and electron emission regions 20 are formed in a circular shaped and placed on the respective first electrodes 16, the present invention is not limited to this case. In other words, the shapes of first electrodes 16 and electron emission regions 20 as well as the arrangement of first electrodes 16 may vary properly.

A diffusion barrier 24 is formed on first substrate 10 to cover cathode electrodes 14. Diffusion barrier 24 prevents the metal material of second electrode 18 from diffusing towards an insulating layer 26 that will be described later, suppressing the deterioration of the resistance of insulating layer 26.

Diffusion barrier 24 may be formed of an insulation material selected from a group of an oxide material such as $SiO_2$ and TiO, a nitride material such as $Si_3N_4$ and TiN, and a combination thereof.

Diffusion barrier 24 formed on first substrate 10 is provided with first openings 241 corresponding to electron emission regions 20 to expose electron emission regions 20. In addition, diffusion barrier 24 may be selectively provided with second openings 242 corresponding to resistance layers 22 to expose resistance layers 22. In this embodiment, both first and second openings 241 and 242 are formed in diffusion barrier 24.

Insulating layer 26 is formed on the diffusion barrier 24 by, for example, a so-called thick film process such as a screen-printing process, such that insulating layer 26 has a thickness of above 3 μm, for example, of approximately 3-10 μm.

Gate electrodes 28 are formed on insulating layer 26 and cross cathode electrodes 14 at right angles. The crossed regions of cathode electrodes 14 and gate electrodes 28 define pixel regions. Openings 181, first electrodes 16, electron emission regions 20 are aligned corresponding to the crossed regions (i.e., the pixel regions).

Openings 261 and 281 corresponding to electron emission regions 20 are formed in the insulating layer 26 and gate electrodes 28, respectively, such that electron emission regions 20 can be exposed on first substrate 10. Openings 261 and 281 of insulating layer 26 and the gate electrodes 28, respectively, may be formed in a circular shape having a diameter greater than a width of electron emission region 20 but less than a width of opening 181 of second electrode 18.

In light emission unit 102, phosphor layers 30 such as red (R), green (G) and blue (B) phosphor layers 30R, 30G and 30B are formed on a surface of second substrate 12 facing first substrate 10, and black layers 32 for enhancing the contrast of the screen are arranged between R, G and B phosphors layers 30R, 30G and 30B.

Each crossed region of cathode and gate electrodes 14 and 18 corresponds to a single color phosphor layer. Phosphor layers may be formed in a stripe pattern running in a longitudinal direction (such as a direction of the y-axis in FIG. 1).

An anode electrode 34 formed of a conductive material such as aluminum is formed on the phosphor and black layers 30 and 32. Anode electrode 34 functions to enhance the screen luminance by receiving a high voltage required for accelerating the electron beams generated in electron emission regions 20, and reflecting the visible light rays, that are radiated from phosphor layers 30 to first substrate 10, toward second substrate 12.

Alternatively, anode electrode 34 can be formed of a transparent conductive material, such as Indium Tin Oxide (ITO), instead of the metallic material. In this case, the anode electrode is disposed on second substrate 12, and phosphor and black layers 30 and 32 are formed on the anode electrode 34.

Disposed between first and second substrates 10 and 12 are spacers 36 (see FIG. 2) for uniformly maintaining a gap between first and second substrates 10 and 12 against the external force. Spacers 36 are arranged corresponding to black layers 32 so that spacers 36 do not block phosphor layers 30.

In the above-described electron emission display, first electrode 16, second electrode 18, electron emission region 20, resistance layer 22, diffusion barrier 24, insulating layer 26, and gate electrode 28, that are disposed at one pixel region, constitute one electron emission element 104.

The above-described electron emission display is driven when a predetermined voltage is applied to cathode 14, gate 28 and anode electrodes 34. For example, one of the cathode and gate electrodes 14 and 28 functions as scanning electrodes receiving a scanning driving voltage, and the other functions as data electrodes receiving a data driving voltage. Anode electrode 34 receives a direct current (DC) voltage of, for example, hundreds through thousands volts, that will accelerate the electron beams.

Then, electric fields are formed around electron emission regions 20 at the pixel regions where a voltage difference between cathode and gate electrodes 14 and 28 is higher than a threshold value and thus the electrons are emitted from electron emission regions 20. The emitted electrons strike phosphor layers 30 of the corresponding pixel region due to the high voltage applied to anode electrode 34, thereby exciting phosphor layers 30.

During the above-described driving process, resistance layers 22 uniformly control the intensity of the current applied to electron emission regions 20. Therefore, in the electron emission display of this embodiment, even when an unstable driving voltage is applied, or the shape uniformity of electron emission regions 20 is not good, the emission current from each electron emission regions 20 is uniform. As a result, the light emission uniformity of the pixels can be enhanced.

In addition, since second electrode 18 of cathode electrode 14 has a relatively low resistance, the voltage-drop and signal distortion of cathode electrode 14 can be effectively suppressed.

Figure 4:
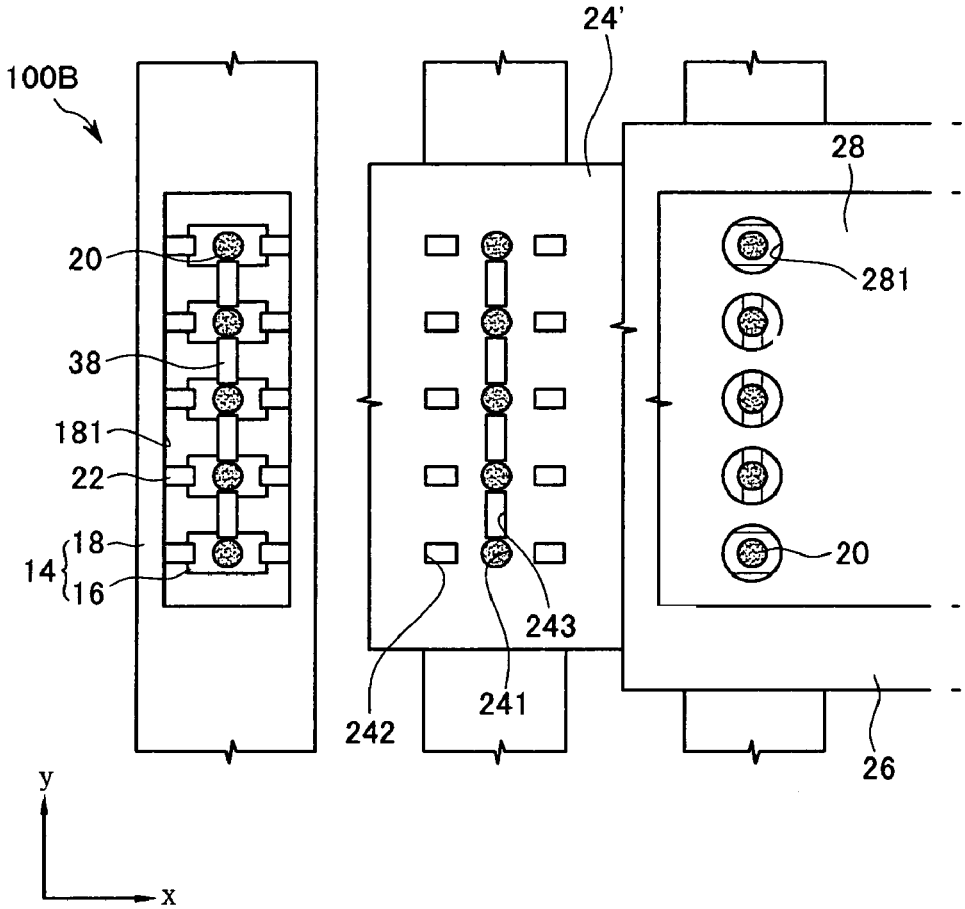
FIG. 4 is a partial top view of an electron emission unit of an electron emission display constructed as another embodiment of the present invention.

FIG. 4 is a partial top view of an electron emission unit of an electron emission display constructed as another embodiment of the present invention.

Referring to FIG. 4, an electron emission unit 100B of this embodiment basically includes the elements of the foregoing embodiment described with reference to FIGS. 1 through 3 and further includes additional resistance layers 38 to provide electrically interconnection between first electrodes 16. At this point, a diffusion barrier 24' includes first openings 241 exposing electron emission regions 20, second openings 242 exposing resistance layers 22, and third openings 243 exposing additional resistance layers 38.

In this embodiment, even when there is a mis-alignment of the plurality of first electrodes 16 disposed within a relatively small area defined by opening 181, the electrical interconnection between first electrodes 16 can be reliably realized by additional resistance layers 38 as well as by resistance layer 22. Therefore, the product defect resulting from the disconnection between first and second electrodes 16 and 18 can be prevented.

Figure 5:
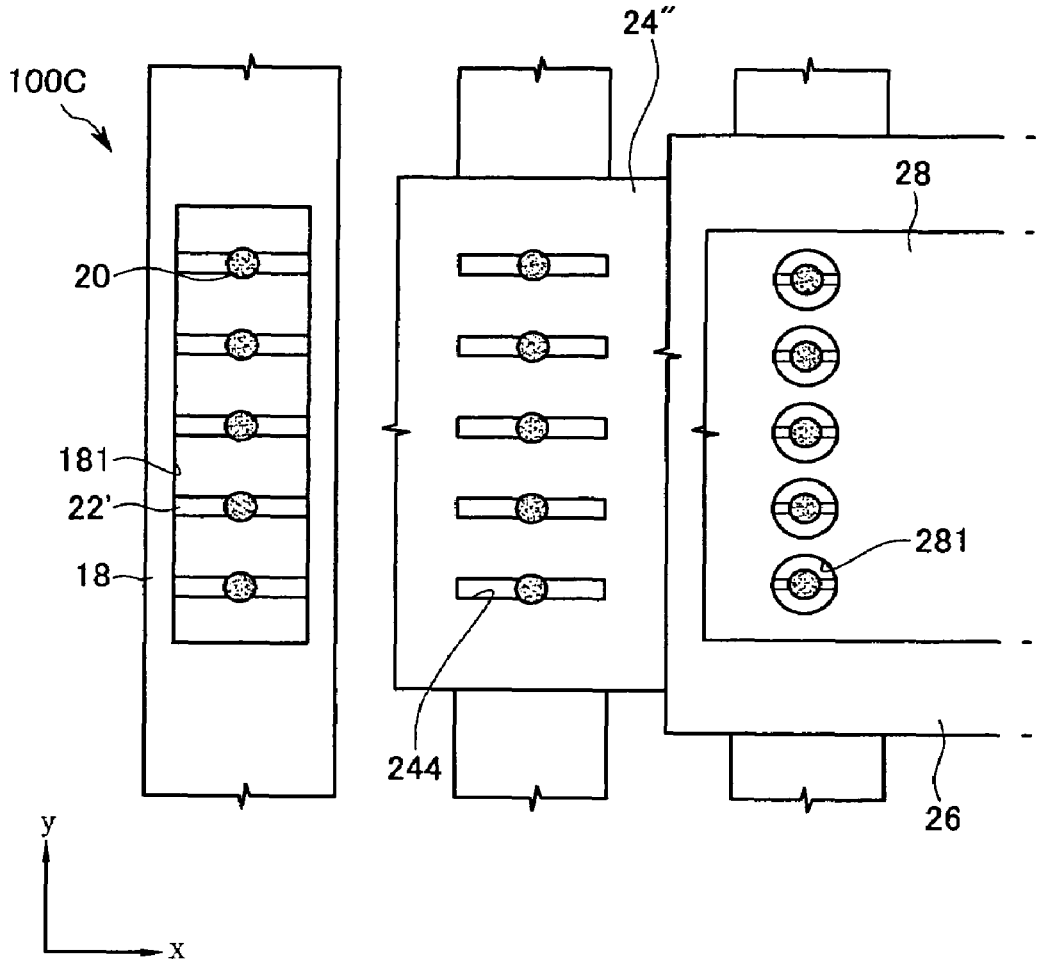
FIG. 5 is a partial top view of an electron emission unit of an electron emission display constructed as another embodiment of the present invention.

FIG. 5 is a partial top view of an electron emission unit of an electron emission display constructed as another embodiment of the present invention.

Referring to FIG. 5, in an electron emission unit 100C of this embodiment, the first electrode of FIG. 1 is omitted and electron emission regions 20 are directly formed on the first substrate. Electron emission regions 20 are electrically connected to second electrode 18 via resistance layers 22'.

In other words, resistance layers 22' are arranged to contact side surfaces of electron emission regions 20 and second electrode 18 at both sides of electron emission regions 20. A diffusion barrier 24" may be provided with openings 244 that can expose not only electron emission regions 20 but also resistance layers 22'.

Figure 6:
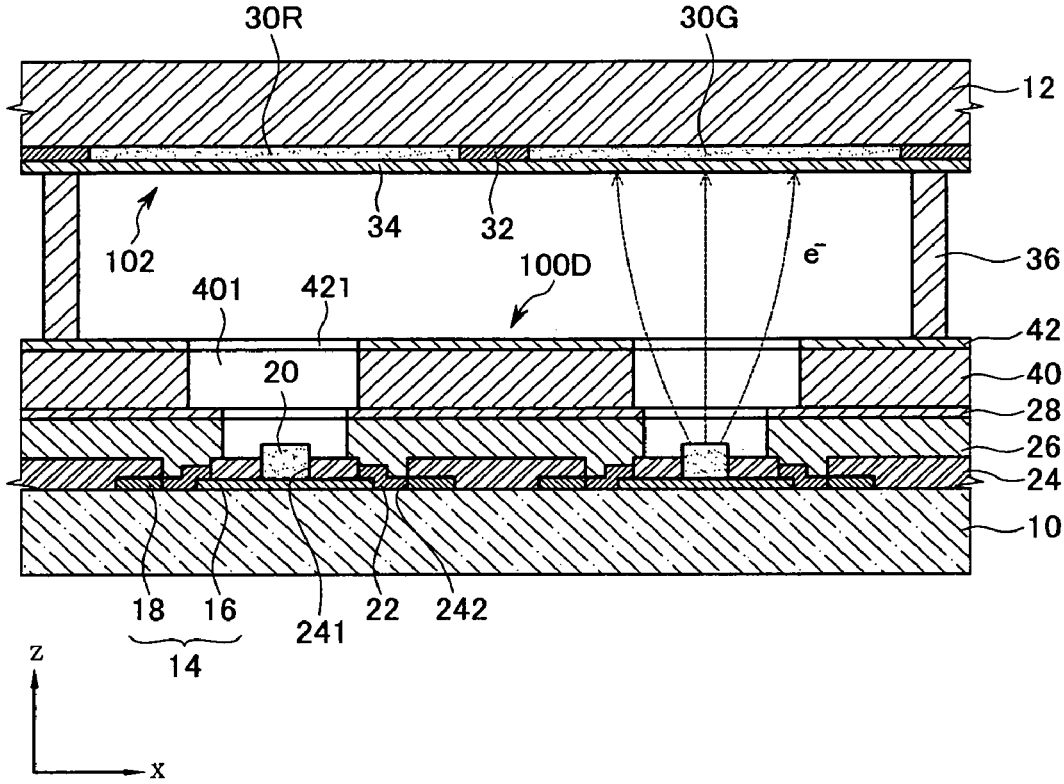
FIG. 6 is a partial cross-sectional view of an electron emission display constructed as another embodiment of the present invention.

FIG. 6 is a partial sectional view of an electron emission display constructed as another embodiment of the present invention.

Referring to FIG. 6, an electron emission display of this embodiment includes, in addition to the elements of the forgoing embodiment described with reference to FIGS. 1 through 3, an additional insulating layer 40 formed on gate electrodes 28 and a focusing electrode 42 formed on additional insulating layer 40. Openings 401 and 421 through which the electron beams pass are formed in additional insulating layer 40 and focusing electrode 42, respectively.

Openings 421 formed in focusing electrode 42 may correspond to the respective pixel regions to generally focus the electrodes emitted from each pixel region. Alternatively, openings 421 formed in focusing electrode 42 may correspond to respective electron emission regions 20 to individually focus the electrons emitted from each electron emission region 20.

A method of manufacturing the electron emission unit of FIG. 3 will now be described with reference to FIGS. 7A through 7I.

Figure 7A:
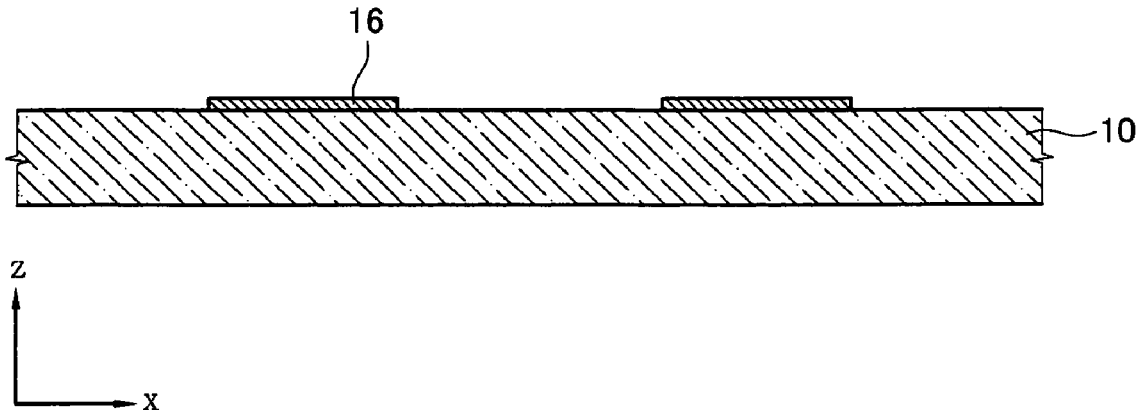
FIGS. 7A through 7I are schematic views illustrating a method of manufacturing the electron emission unit of FIG. 3.
Figure 7B:
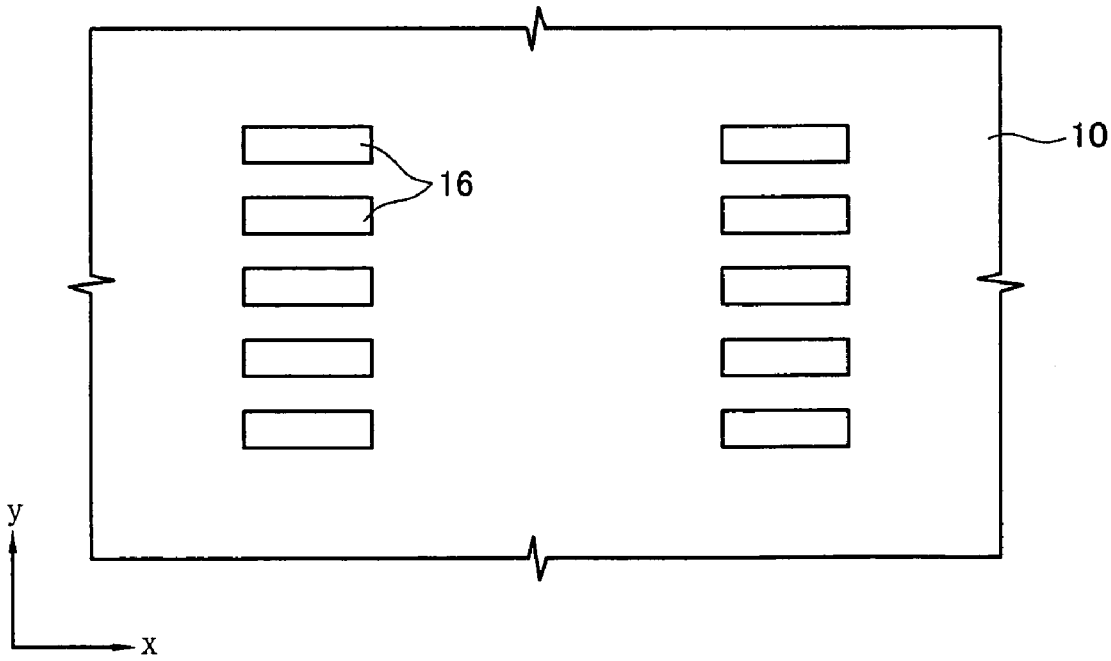

Referring first to FIGS. 7A and 7B, the first electrodes 16 are formed on first substrate 10 using either ITO or IZO. First electrodes 16 may be formed in a rectangular shape and arranged in parallel with each other along first substrate 10 in the direction of a y-axis (see FIG. 7B).

Figure 7C:
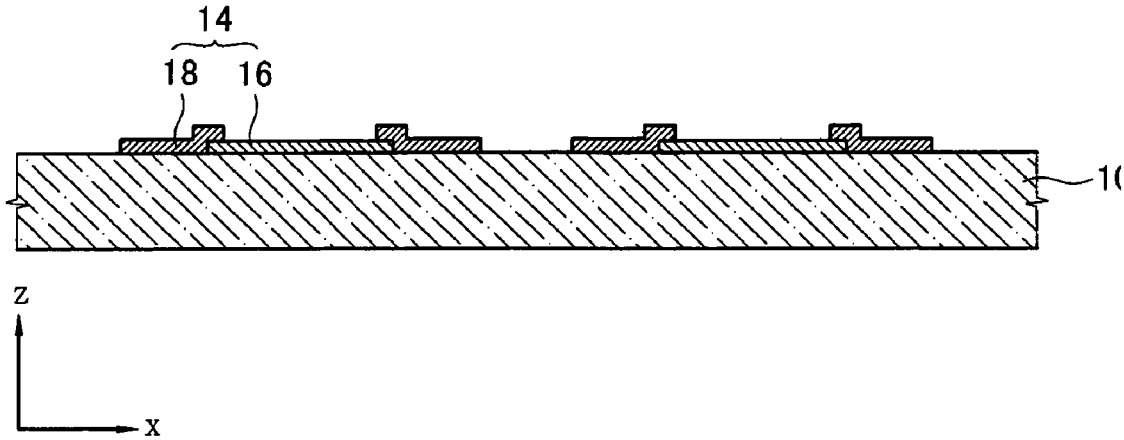
Figure 7D:
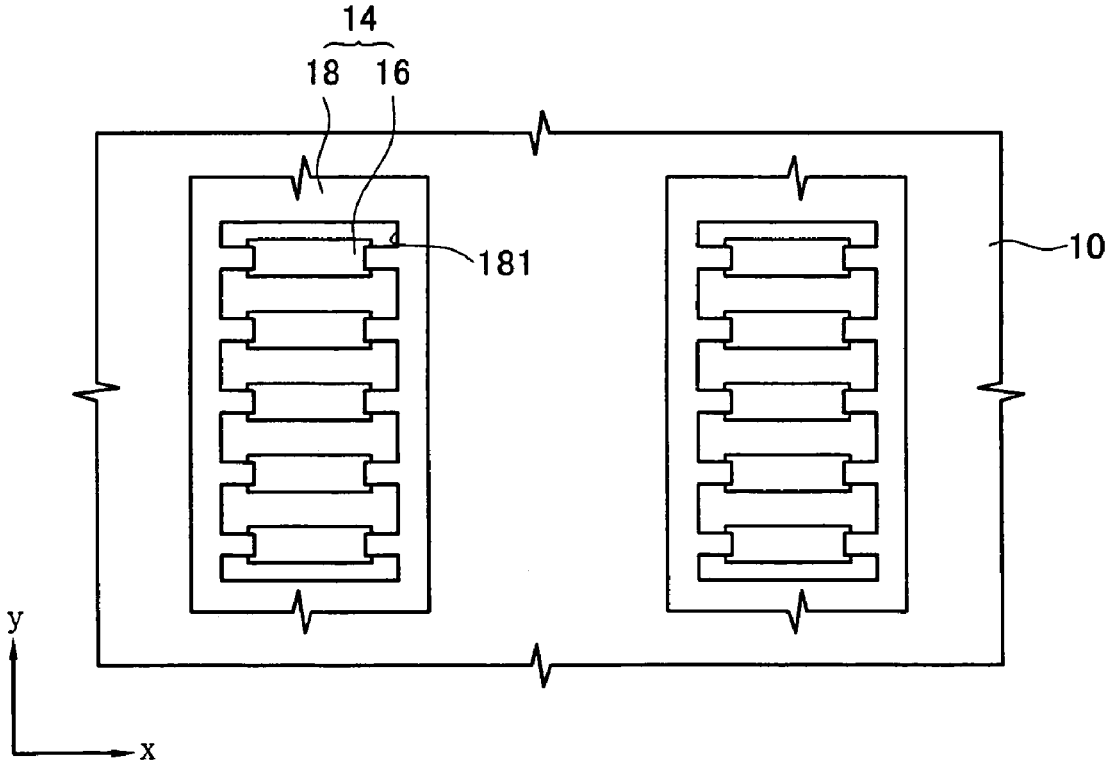

Referring to FIGS. 7C and 7D, a metal layer is formed on first substrate 10 using a metal selected from a group of Cr, Mo, Nb, Ni, W, Ta, Al, Pt, and a combination thereof, and the metal layer is formed in a predetermined pattern to create second electrodes 18.

Second electrodes 18 are formed in a spaced-apart striped pattern and run in a direction in which first electrodes 16 are arranged. Each second electrode 18 is patterned to have opening 181 within which first electrodes 16 are arranged. Second electrode 18 extends from both sides of first electrodes 16 to contact first electrodes 16, thereby forming cathode electrodes 14 having first and second electrodes 16 and 18.

Figure 7E:
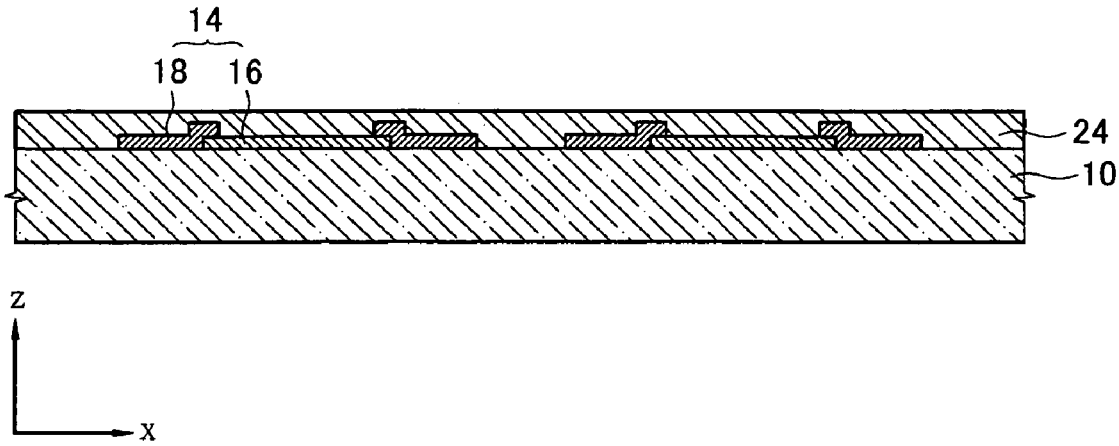

Referring to FIG. 7E, diffusion barrier 24 is formed on first substrate 10 to cover the first and second electrodes 16 and 18. Diffusion barrier 24 may include an insulation material selected from a group of an oxide material such as $SiO_2$ and TiO, a nitride material such as $Si_3N_4$ and TiN, and a combination thereof. Diffusion barrier 24 may be formed having a thickness of approximately 0.1~1 μm by a so-called thin film process such as a sputtering process.

Figure 7F:
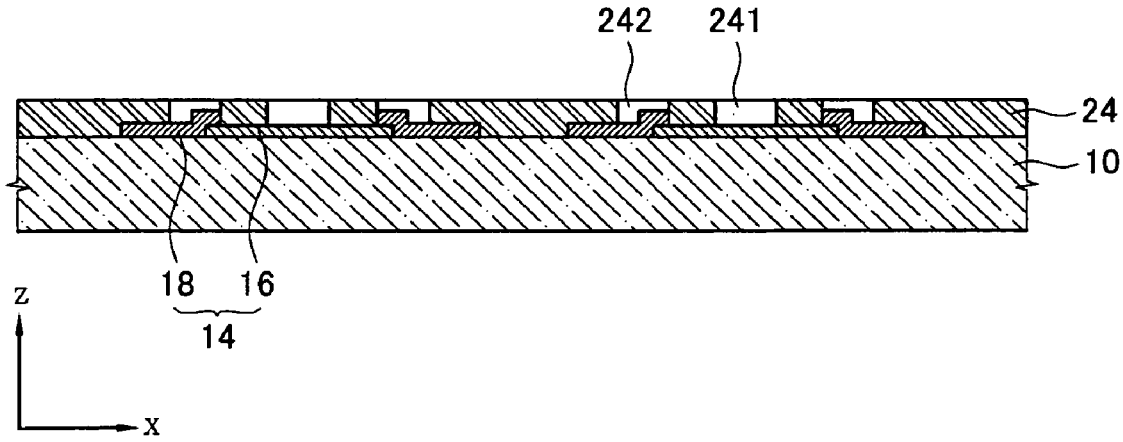

Referring to FIG. 7F, diffusion barrier 24 is processed by a conventional photolithography process to form first openings 241 exposing a portion of each first electrode 16 and second openings 242 exposing a portion of second electrode 18. Electron emission regions 20 will be formed on the exposed portions of respective first electrodes 16 through first openings 241, and resistance layers 22 will be formed on the exposed portion of second electrode 18 through second openings 242 in the following steps.

Figure 7G:
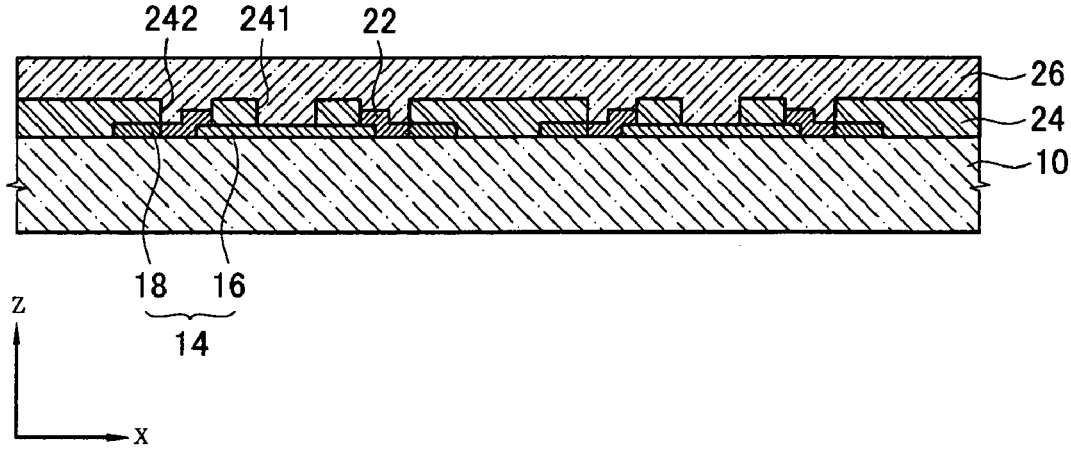

Referring to FIG. 7G, an insulation material such as an oxide material or a nitride material is applied over first substrate 10 and dried and fired to form insulating layer 26. The application of the insulation material may be conducted through a screen-printing process, and the firing temperature of the insulation material may be approximately 540~570° C. Insulating layer 26 may have a thickness of about 3~10 μm.

When insulating layer 26 is fired, diffusion barrier 24 prevents the metal material of second electrode 18 from diffusing into insulating layer 26, thereby suppressing the deterioration of the resistance of insulating layer 26. During the firing process of insulating layer 26, the portions of second electrode 18 that are exposed by second opening 242 of diffusion barrier 24 are oxidized or nitrided to form resistance layers 22.

In other words, when insulating layer 26 is formed from an oxide material, portions of second electrode 18 that contact insulating layer 26 are oxidized during the firing process for insulating layer 26, thereby forming resistance layers 22 from the metal oxide material. Alternatively, when the insulating layer is formed of the nitride material, the portions of second electrode 18 that contact the insulating layer 26 are nitrided during the firing process for insulating layer 26, thereby forming resistance layers 22 from the metal nitride material.

Alternatively, resistance layers 22 may be formed by either oxidizing or nitriding the contacting portions between second electrode 18 and first electrodes 16 before diffusion barrier 24 and insulating layer 26 are formed. In this case, diffusion barrier 24 may be provided with only first openings 241 for exposing the electron emission regions.

Figure 7H:
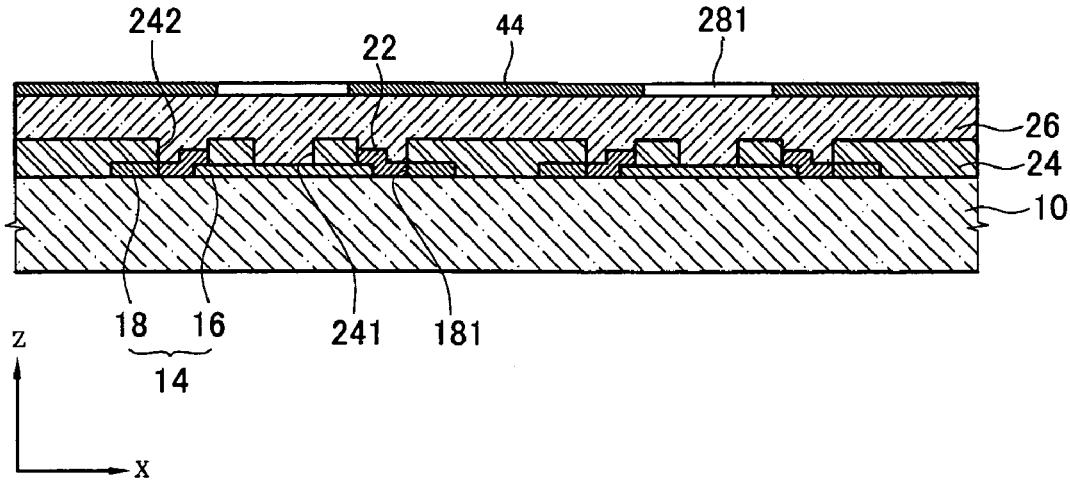

Referring to FIG. 7H, metal layer 44 is formed on insulating layer 26, and openings 281 corresponding to the crossed regions of cathode electrodes 14 and metal layer 44 are formed in metal layer 44 by the conventional photolithography process. The diameter of each opening 281 is greater than a width of first opening 241 of diffusion barrier 24, but less than a width of opening 181 of second electrode 18.

Figure 7I:
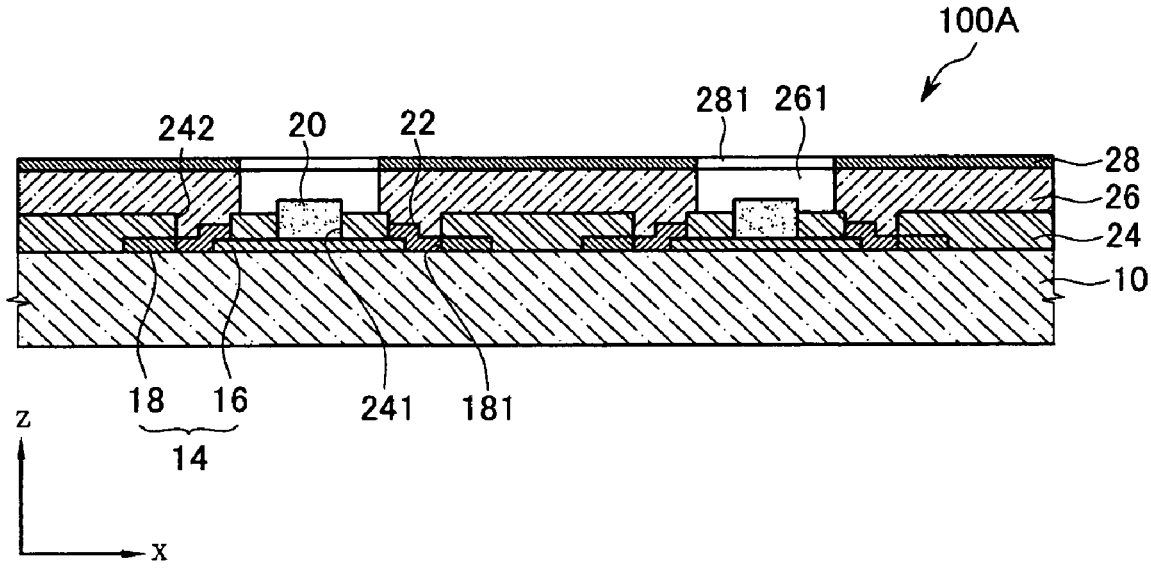

Referring to FIG. 7I, openings 261 are formed in insulating layer 26 by etching the portions of insulating layer 26 that are exposed by openings 281. Metal layer 44 is processed into create a striped patterns by the photolithography process to form gate electrodes 28 crossing cathode electrodes 14 at right angles.

Then, electron emission regions 20 are formed on the respective first electrodes 16 through first openings 214 of diffusion barrier 24.

Electron emission regions 20 are formed by printing paste formed by mixing vehicles with an organic material such as binders onto the respective first electrodes 16, and drying and firing the printed paste.

Alternatively, a photosensitive material may be mixed with the paste. This resulting mixture is screen-printed over first substrate 10 and ultraviolet rays are emitted to the rear surface of first substrate 10 to harden portions of the printed mixture to which the ultraviolet rays are emitted through first substrate 10 and first electrodes 16. In this case, first substrate 10 is formed with a transparent glass and first electrodes 16 are formed with a transparent conductive material. The portions of the printed mixture that are not hardened are removed through a developing process and the remaining printed mixture is dried and fired, thereby forming electron emission regions 20.

Alternatively, electron emission regions 20 may be formed through either a direct growth, a chemical vapor deposition, or a sputtering.

According to the above-described method, since the portions of second electrode 18 are phase-changed into resistance layers 22 during the firing process for insulating layer 26, a process for forming an additional layer for resistance layers 22 and patterning the additional layer can be omitted, thereby simplifying the manufacturing process. In addition, the disconnection between first and second electrodes 16 and 18, which may be caused by the mis-alignment of the resistance layers, may be effectively prevented.

Although the manufacturing method is described with reference to the electron emission unit of FIG. 3, it should be understood that the electron emission unit of FIG. 4 could be easily manufactured by modifying the shape of the second electrode and forming the third openings in the diffusion barrier.

It should also be understood that in accordance with the principles of the present invention, the electron emission unit of FIG. 5 may easily be manufactured by omitting the process for forming the first electrodes and increasing the length of the resistance layer. Furthermore, it should also be understood that the electron emission unit of FIG. 6 could be easily manufactured by forming the additional insulating layer and the focusing electrode above the insulating layer and the gate electrodes and forming the opening in the additional insulating layer and the focusing electrode.

Although exemplary embodiments of the present invention have been described in detail hereinabove, it should be clearly understood that many variations and/or modifications of the basic inventive concept taught herein still fall within the spirit and scope of the present invention, as defined by the appended claims.

What is claimed is:

1. An electron emission element, comprising:

a first electrode and a second electrode spaced apart from the first electrode;

an electron emission region disposed on the first electrode; and a resistance layer for electrically connecting the first electrode to the second electrode, the resistance layer being formed of one of a metal oxide material and a metal nitride material.

2. The electron emission element of claim 1, comprised of one of the metal oxide material and the metal nitride material comprising a metal selected from a group consisting essentially of Cr, Mo, Nb, Ni, W, Ta, Al, Pt, and combinations thereof.

3. The electron emission element of claim 1, comprised of the first electrode being formed of a transparent conductive material and the second electrode being formed of a metal.

4. The electron emission element of claim 3, comprised of the one of the metal oxide material and the metal nitride material comprises a metal that is identical to the second electrode.

5. An electron emission display device, comprising:

first and second substrates facing each other;

a cathode electrode formed on the first substrate;

an electron emission region electrically connected to the cathode electrode;

a resistance layer electrically connected to the cathode electrode and the electron emission region;

a diffusion barrier formed on the first substrate, the diffusion barrier covering the cathode electrode and having an opening corresponding to the electron emission region;

a gate electrode formed above the diffusion barrier with an insulating layer interposed therebetween, both of the gate electrode and the insulating layer having openings corresponding to the electron emission region;

a phosphor layer formed on the second substrate; and an anode electrode formed on one surface of the phosphor layer.

6. The electron emission display device claim 5, with the resistance layer being formed of one of a metal oxide material or a metal nitride material.

7. The electron emission display device of claim 6, comprised of one of the metal oxide material and the metal nitride material comprising a metal selected from a group consisting essentially of Cr, Mo, Nb, Ni, W, Ta, Al, Pt and a combination thereof.

8. The electron emission display device of claim 5, with the diffusion barrier comprising an insulation material selected from a group consisting essentially of $SiO_2$, TiO, $Si_3N_4$, TiN, and a combination thereof.

9. The electron emission display device of claim 8, comprised of a height of the diffusion barrier being lower than that of the electron emission region.

10. The electron emission display device of claim 5, with the cathode electrode comprising a first electrode and a second electrode spaced apart from the first electrode and the electron emission region being formed on the first electrode.

11. The electron emission display device of claim 10, comprised of the first electrode being formed from a transparent conductive material and the second electrode is formed of a metal.

12. The electron emission display device of claim 10, comprised of the second electrode being an opening receiving the first electrode and the resistance layer is formed at both sides of the first electrode.

13. The electron emission display device of claim 12, further comprising additional first electrodes that are arranged within the opening of the second electrode and additional resistance layers electrically interconnecting the first electrodes.

14. The electron emission display device of claim 10, comprised of the second electrode having a resistance lower than the first electrode.

15. The electron emission display device of claim 5, comprised of the resistance layer being formed from one of a metal oxide material and a metal nitride material, and the one of the metal oxide material and the metal nitride material comprises a metal identical to the second electrode.

16. The electron emission display device of claim 5, further comprising a focusing electrode formed above the gate electrode with an insulating layer interposed therebetween.

* * * * *